United States Patent [19]

Watts et al.

[11] 4,202,363

[45] May 13, 1980

[54] UMBRELLA TYPE COLLAPSIBLE SHELTER

[75] Inventors: Paul J. Watts, Sandy; Lynn D. Crawford; Philip T. Nichols, both of Salt Lake City, all of Utah

[73] Assignee: American Ecosystems, Inc., Salt Lake City, Utah

[21] Appl. No.: 950,028

[22] Filed: Oct. 10, 1978

[51] Int. Cl.[2] ..... A45F 1/04

[52] U.S. Cl. ..... 135/2; 135/3 E; 135/4 R

[58] Field of Search ..... 135/2, 3 E, 4 R, 1 D, 135/3 C, 4 B, 4 C

[56] References Cited

U.S. PATENT DOCUMENTS

| | | | |
|---|---|---|---|
| 2,864,389 | 12/1958 | Smith | 135/2 |
| 3,455,310 | 7/1969 | Peterson | 135/2 |
| 3,794,054 | 2/1974 | Watts | 135/2 |
| 3,874,397 | 4/1975 | Oberhaus | 135/2 |
| 3,929,146 | 12/1975 | Maiken | 135/2 |

*Primary Examiner*—Reinaldo P. Machado
*Attorney, Agent, or Firm*—Criddle & Western

[57] ABSTRACT

A collapsible shelter of the umbrella-tent type including a foldable frame and a cover of sheet material affixed to the frame. The frame comprises a plurality of support members having mutually respective ends pivotally connected to a central hub. The central hub is mounted on elongate erecting guide means located at the apex of the frame. A second hub is mounted on the guide means below the central hub, and a plurality of rib members are pivotally connected at mutually respective ends to the second hub, with the other ends of the rib members being pivotally connected to corresponding, respective support members, so that when the shelter is in its erected form, the support members extend outwardly and downwardly from the central hub, the second hub is positioned adjacent or proximate to the central hub, the rib members extend substantially radially outwardly from the erecting guide, and the cover is held tautly affixed to the frame. Means are provided for releasably connecting and holding the second hub and the central hub together as a rigid unit to avoid untimely collapse of the shelter by inadvertent, undesired, downward movement of the second hub away from the central hub. The shelter can be collapsed, when desired, by disengaging the second hub from the central hub and moving the second hub downwardly away from the first hub. When the shelter is collapsed, the support members extend downwardly as a bundle from the central hub, the ribs are folded to positions substantially within the bundle of collapsed support members, and the cover is loosely affixed to the frame. In a preferred embodiment, the support members are segmented and can be folded upon themselves to greatly shorten the length of the collapsed bundle thereof.

9 Claims, 9 Drawing Figures

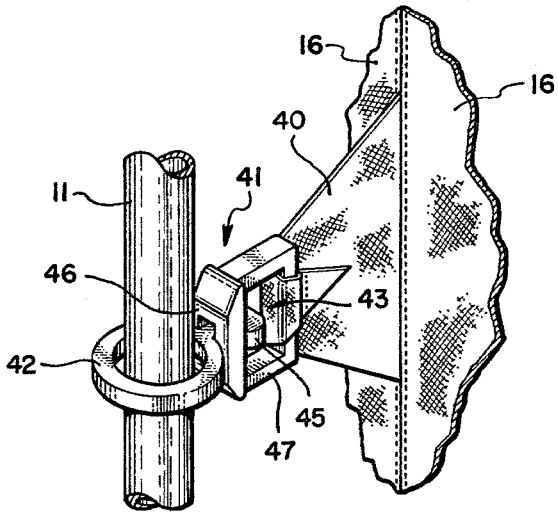
FIG. 6
FIG. 7
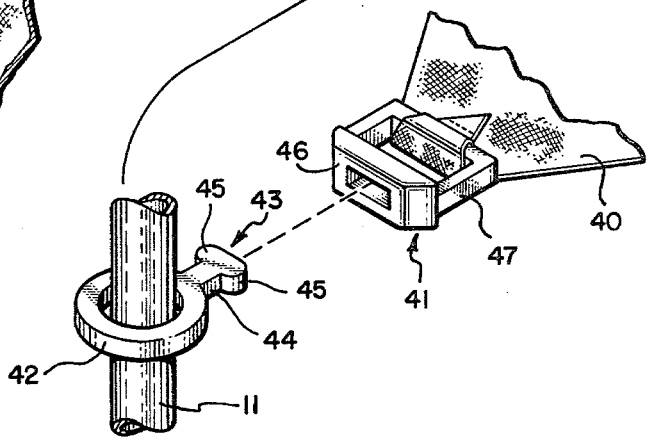
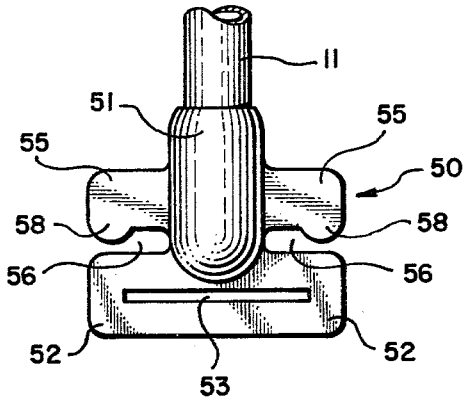
FIG. 9
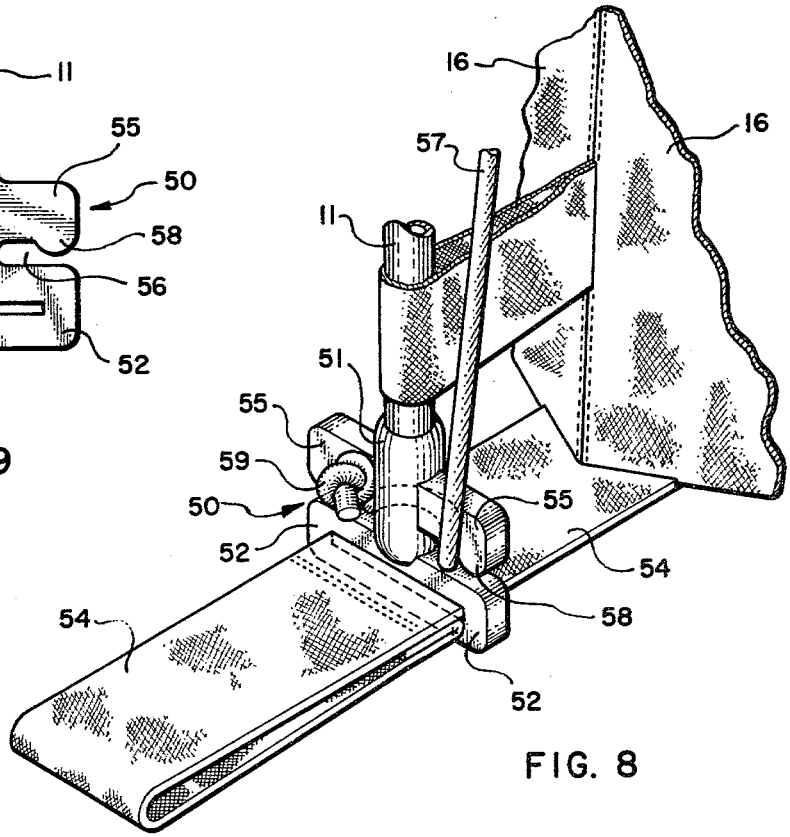
FIG. 8

UMBRELLA TYPE COLLAPSIBLE SHELTER

BACKGROUND OF THE INVENTION

1. Field

The invention pertains generally to collapsible shelters of the umbrella-tent type. In particular, the invention relates to a portable shelter, including a foldable frame with the shelter cover, i.e., canopy, affixed thereto, which is adapted for quick, easy erection from its folded, compact form and vice-versa.

2. State of the Art

In recent years, backpacking has become very popular, and portable, single unit tents, which have the frame and canopy incorporated into one unit and can be folded into a compact, lightweight package, have been provided to take the place of the older, more cumbersome tents in which a frame and canopy are separable from each other. A sturdy, lightweight, foldable quickly erectable and collapsible shelter of the umbrella type is disclosed in U.S. Pat. No. 3,794,054, issued to Paul J. Watts on Feb. 26, 1974. In accordance with the disclosure of that patent, a frame and canopy are provided in a single unit wherein the material of the canopy is held loose on the frame when the shelter is in a collapsed position and taut on the frame when the shelter is in an erected position. In addition, the central pole of conventional umbrella-type tents was eliminated, with the shelter retaining all the structural stability of such umbrella tents having a central pole.

The frame of the shelter disclosed in U.S. Pat. No. 3,794,054 includes a vertical erecting rod located at the apex of the frame. The erecting rod is adapted to slide up and down through a central hub which forms the apex of the frame. A plurality of flexible, segmented support members are pivotally attached to the central hub, and an equal number of rib members are pivotally attached at mutually respective ends to the support members. The other ends of the rib members are pivotally attached to a second hub which is mounted on the erecting rod below the central hub, so that when the second hub is moved into proximity of the central hub, the support members assume a position extending outwardly and downwardly from the central hub with the cover or canopy tautly affixed thereto, and the rib members extends substantially radially outward from the second hub. In the erected position, the second hub has a resultant force acting thereon which tends to hold it against the central hub due to an over-center type action achieved by raising the second hub to a position such that the rib members pass the equilibrium position perpendicular to the erecting rod and slant slightly upward towards the center of the tent. However, it has been found that inadvertent, undesired downward movement of the second hub, with the resulting untimely collapse of the shelter, can occur under certain circumstances in normal use of the shelter. For example, the shelter is subject to untimely collapse under cetain wind conditions which cause depression of the apex of the shelter.

Objectives

The principal objective of this invention is to provide improved erection means for collapsible shelters, such as those disclosed in U.S. Pat. No. 3,794,054, whereby inadvertent, unintended collapse of the shelters under substantially all circumstances which may be encountered in normal use of the shelters is prevented. A particular object of the invention is to provide means for positively preventing unintended downward movement of the second hub which would otherwise result in the collapse of the shelter. Another object of the invention is to provide means for releasably connecting and holding the first and second hubs together as a rigid unit when the shelter is in the erected position, thereby completely preventing unintended collapse of the shelter.

SUMMARY OF THE INVENTION

The above objectives are achieved in accordance with the present invention by providing an improved, sturdy, lightweight, foldable, quickly erectable shelter of the type disclosed in U.S. Pat. No. 3,794,054. For that reason, the entire contents of U.S. Pat. No. 3,794,054 are incorporated into this specification by reference.

The shelter in accordance with this invention includes a foldable frame and a cover of sheet material, i.e., canopy, affixed to the frame. The frame comprises an erecting guide upon which first and second hubs are mounted. A plurality of support members are pivotally attached at mutually respective ends to the first hub. When the shelter is in its erected form, the support members extend outwardly and downwardly from the first hub to the ground to provide for the basic superstructure which supports the canopy. A plurality of rib members are pivotally connected at mutually respective ends to the second hub, with the other ends of the rib members being pivotally connected to respective support members. At least one of the first and second hubs is adapted for sliding movement along the erecting guide so that the hubs are adjustable between a position remote from each other to a position proximate or adjacent each other, and the frame of the shelter can be erected and collapsed in a manner similar to the raising and lowering of an ordinary umbrella.

The improvement of the present invention provides means for actively, as compared to passively, restraining the second hub in its position proximate or adjacent the first hub when the shelter is in the erected position, thereby preventing inadvertent, unintended collapse of the shelter. The means for restraining the second hub proximate the first hub is also adapted to release such restraint when desired so that the second hub can be moved downward away from the first hub to take the shelter down and store it in its collapsed and folded form.

Other features and advantages of the invention will become apparent from the following detailed description; taken together with the accompanying drawings.

THE DRAWINGS

Figure 5:
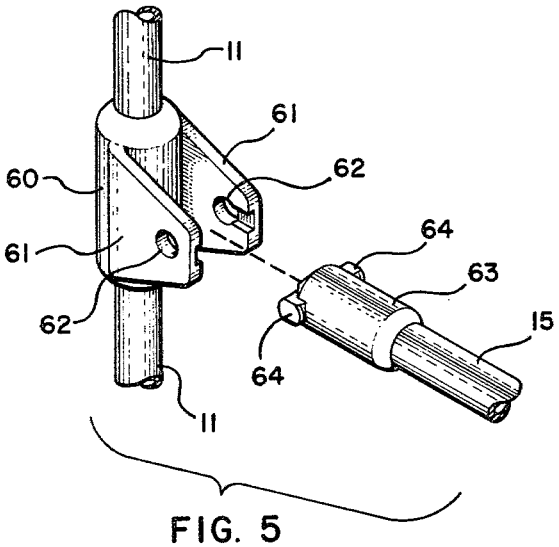

1, with the two hubs being in their positions proximate each other;

FIG. 5 is an exploded perspective of the hinge connecting means for pivotally connecting an end of the rib member to a corresponding support member;

FIG. 6 is a partial perspective showing a preferred means of slidably attaching portions of the canopy to the support members of the frame;

FIG. 7 is an exploded perspective showing the separate parts of the attaching means of FIG. 6;

FIG. 8 is a partial perspective showing a preferred foot assembly on the end of a support member which is adapted to engage the ground; and FIG. 9 is an elevation view of the foot assembly of FIG. 8, to which the tent fabric or webbing has not been attached.

DETAILED DESCRIPTION OF THE ILLUSTRATED EMBODIMENTS

Figure 1:
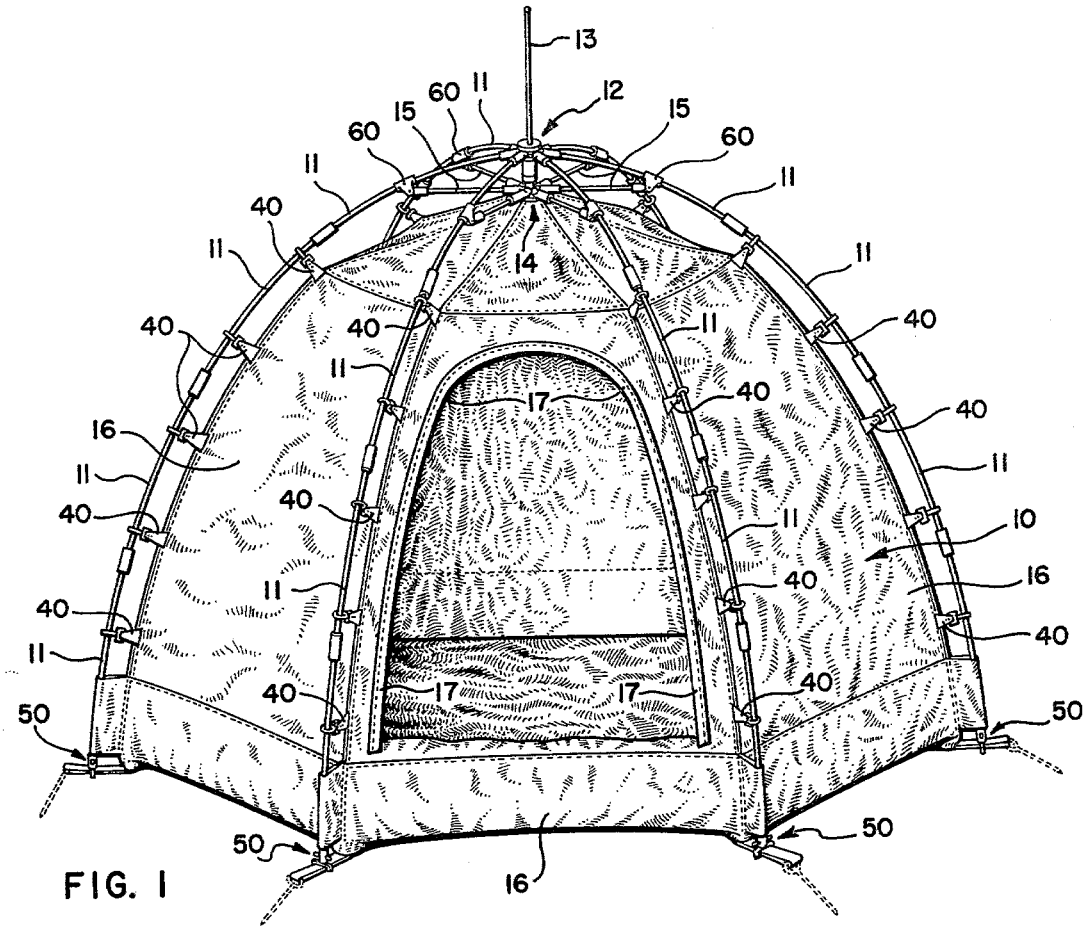
FIG. 1 is a perspective view of a tent in accordance with the invention wherein the guide means comprises a vertical erecting rod.

Referring now to the drawing:

An umbrella-type tent or shelter in accordance with the present invention is shown in general in FIG. 1, with various preferred features and variations of such features illustrated in more detail in FIGS. 2–9. Like parts or assemblies of the tent or shelter are identified by the same numeral in the various figures.

The shelter in the form of an umbrella tent is shown in its erected position in FIG. 1. The tent, as illustrated, has a supporting frame located substantially exterior to the fabric covering or canopy 10 of the tent, such that the fabric or canopy 10 is suspended from the frame. It is, of course, recognized that the supporting frame could be positioned interior of the fabric cover or canopy 10, and such an arrangement is encompassed by the present invention. However, for clarity in describing and illustrating the various features of the present invention, it is expedient to refer to the tent structure having an exterior frame as illustrated in the drawings.

As illustrated, the frame includes a plurality of flexible, segmented support members 11 which are attached at mutually respective ends to a central hub 12. The central hub 12 is mounted on an elongate erecting guide means 13, shown as rod in FIGS. 1, 2, and 4 and as a rope or cord in FIG. 3. In the erected position, as shown in FIG. 1, the support members 11 are bowed outwardly and downwardly to form a conical or bell shaped superstructure for supporting the cover of sheet material 10, i.e., the canopy.

Figure 3:
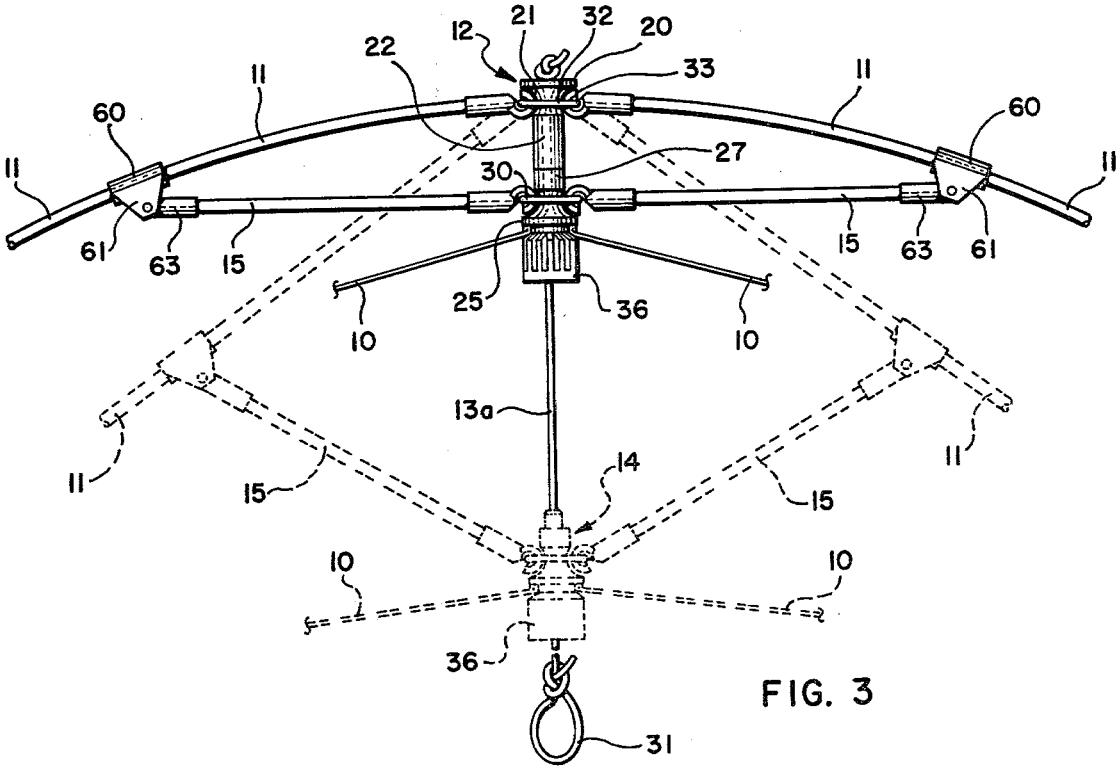
FIG. 3 is a partial elevation of the top section of the shelter of FIG. 1, showing two opposed pairs of support and rib members and illustrating the use of a rope as the erecting guide means.
Figure 2:
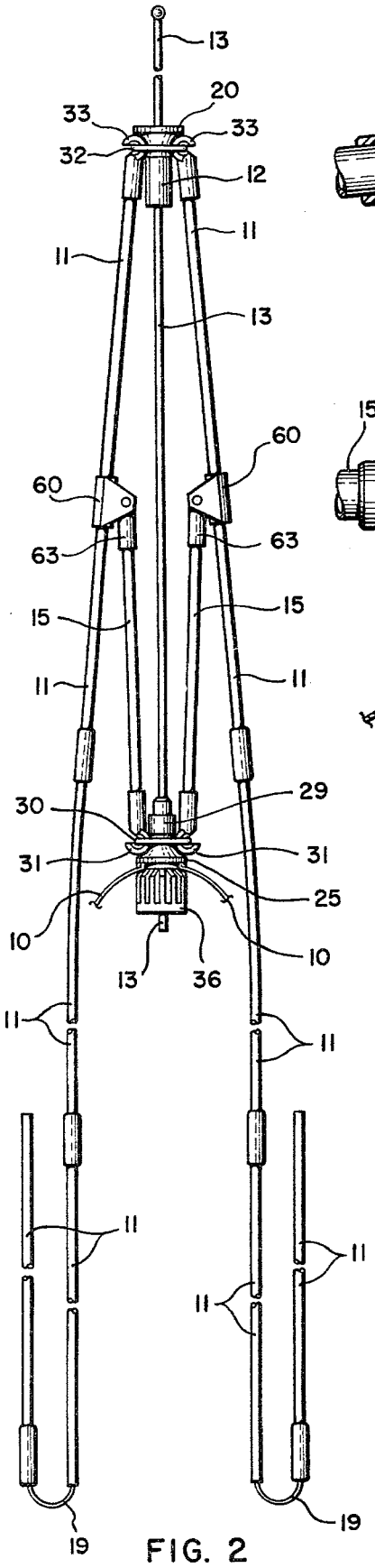
FIG. 2 is a front elevation view of a portion of the frame of the shelter in FIG. 1, with the canopy broken away and the frame in a collapsed and partially folded position, and with the lower end of the erecting rod is integrally attached to the lower hub.
Figure 4:
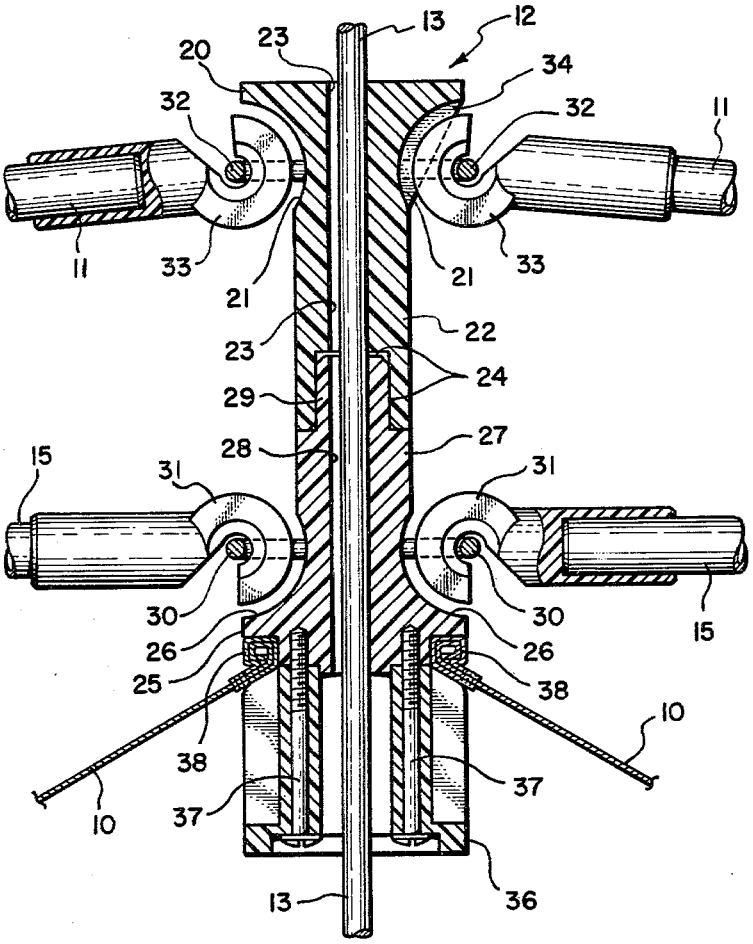
FIG. 4 is an enlarged, vertical section through the erecting rod and associated hubs of the shelter of FIG.

A second hub 14 is mounted on the guide means 13 below the central hub 12. At least one of the hubs 12 and 14 is adapted for sliding movement along the erecting rod 13 so that the two hubs 12 and 14 are adjustable between a collapsed position, in which the hubs 12 and 14 are located remote from each other as shown in FIG. 2, and an erected position, in which the hubs 12 and 14 are located proximate or adjacent each other as shown in FIGS. 1, 3, and 4.

A plurality of rib members 15 are pivotally connected at mutually respective ends to the second hub 14, with the other ends of the rib members 15 being pivotally connected to corresponding, respective support member 11, so that when the shelter is in its erected form, the support members 11 extend outwardly and downwardly from the central hub, and the rib members 15 extend substantially radially outwardly from the erecting guide means 13. When the shelter is collapsed, the rib members 15 extend downwardly as shown in FIG. 2, substantially within the support members 11 which extend downwardly as a bundle from the central hub 12, with the support members being in proximate side-by-side relationship with themselves and the rib members 15.

The fabric cover or canopy 10 comprises a plurality of vertical panels 16 (FIG. 1), preferably equal in number to the number of support members 11. The shelter shown in FIG. 1 employs six support members 11 equally spaced around and connected to the central hub 12, and, therefore, the cover or canopy 10 comprises six vertical panels 16. An opening, such as door 17 is provided in one of the panels 16 to provide access to the inside of the tent. As illustrated, the door 17 comprises a zipper which forms an inverted U-shape in the panel, and when the zipper is disconnected the portion of the panel in the inverted U-shaped space falls downwardly to provide the opening into the tent. The opening is closed by zippering the portion of the panel up in its closed position.

Each panel 16 is connected to its two adjacent panels along its respective side edges, and the cover or canopy 10 has a hexagonal, horizontal, cross-sectional shape. A bottom or floor for the shelter can be provided by being connected along the bottom edges of the panels 16. The cover or canopy 10 is attached at several positions along its side edges to the corresponding support member 11 as will be more fully explained hereinafter, so that the points of connection can slide along the support member 11.

In the erection of the shelter of this invention, the rib members 15 are articulated from a position substantially parallel and proximate the vertical centerline of the frame to a position extending substantially radially outwardly from the centerline. During such movement, the support members 11 of the frame are pivoted outwardly from the central hub 12 of the frame. During the initial movement of the rib members 15, the ground engaging ends of the support members 11 move to the outer circumference of the base of the shelter and are restrained from further outward movement by the canopy 10. As the rib members 15 continue to move to a point at which they are substantially perpendicular to the vertical center line of the shelter, the flexible support members are forced into their outwardly bowed shape as shown in FIG. 1. As the rib members 15 move past the position perpendicular to the vertical center line of the shelter, there is a resultant upward force exerted on the second hub 14 due to the stress in the bowed support members 11. This upward force on hub 14 tends to hold it proximate to the central hub 12, thereby maintaining the shelter in the erected position. However, as mentioned previously, it has been found that in normal use of such a shelter, inadvertent, undesired collapse of the shelter often occurs due to various conditions, such as strong winds which cause depression of the apex of the shelter, resulting in the downward movement of the second hub away from the central hub. In accordance with the present invention, means are provided for preventing inadvertent collapse of the shelter due to such downward movement of the second hub 14 away from the central hub 12. In particular, the central hub 12 and second hub 14 are designed to be quickly and releasably connected together as a rigid unit during the erection of the shelter, and by positively holding the two hubs together as a unit, inadvertent, untimely collapse of the shelter is completely prevented.

In a preferred embodiment of the hubs 12 and 14, as shown in the drawings, in particular FIGS. 2–4, the first hub, i.e., the central hub 12, includes an annular upper cap portion or top 20, a narrower diameter neck portion 21 (FIG. 4), and an annular, lower collar portion 22 of a diameter somewhat larger than diameter of the neck portion 21. A cylindrical bore 23 (FIG. 4) extends through the central hub 12, with the elongate erecting guide member 13 passing through the bore 23. The lower end of the first hub 12, i.e., the end thereof which faces the second hub 14, has a counterbore 24 therein which is eccentric with the bore 23, and, therefore eccentric with respect to the longitudinal axis of the erecting guide member 13. The second hub 14 is of a construction similar to that of the first hub 14 in that it comprises an annular bottom cap 25, a narrower diameter neck portion 26 (FIG. 4), and an annular upper collar portion 27 of a diameter somewhat larger than the diameter of the neck portion 26. A cylindrical bore 28 (FIG. 4) extends through second hub 14, with the erecting guide means 13 passing through the bore 28. The upper end of the second hub 14, i.e., the end thereof which faces the first hub 12, has an upstanding cylindrical projection 29 (FIGS. 2 and 4) which is adapted for sliding engagement within the counterbore 24 of the first hub 12. The cylindrical projection is eccentric with the bore 28 and, thus, eccentric with respect to the guide means 13 which passes through bore 28.

As illustrated, at least one of the hubs 12 and 14 is adapted for sliding movement relative to the erecting means 13. In erecting the shelter, the hubs are moved from their collapsed positions as shown in FIG. 2 to their erected positions as best shown in FIGS. 1 and 3 (an intermediate position through which the hubs pass during both the erection or collapse of the shelter is shown by dotted lines in FIG. 3). As can be seen from the drawings, the second hub 14 is moved along the guide means 13 toward the first hub 12 during the erection of the shelter. When the erecting means 13 takes the form of an elongate rod as shown in FIGS. 1, 2, and 4, the second hub 14 can be adapted for slidable movement along the rod, as shown, and when second hub 14 has attained a position adjacent to the first hub 12, the erecting rod 13 is pushed through the bores 23 and 28 of the respective hubs so that it extends upwardly from the first hub 12 on the outside of the shelter as shown in FIG. 1. In an alternative embodiment not shown in the drawings, the lower end of the erecting rod can be attached to or otherwise molded integrally with the second hub 14. Then as the second hub 14 moves toward the first hub 12, in erecting the shelter, the erecting rod concurrently slides through the bore 23 in the first hub 12, so as to extend outside the shelter when the second hub 14 has attained its position adjacent to the first hub 12. Irrespective of whether the erecting guide passes through a bore in the second hub 14 or is attached to or molded integrally therewith, the important aspect is that the elongate guide extends from the free end of the cylindrical extension 29 of the second hub 14 and then through the bore 23 in hub 12.

As mentioned above, the erecting guide means can be a rope or cord **13*a* as shown in FIG. 3. The rope 13*a* passes through the bores 23 and 28 of the respective hubs 12 and 14, with a knot 30 being formed in the upper end thereof which prevents the upper end of the rope 13*a* from being pulled through the bore 23 in the first hub 12. The rope 13*a* hangs downwardly through the bores 23 and 28 of hubs 12 and 14, respectively, and a loop 31 is formed at the downward end thereof for manually grasping the rope 13*a* during erection of the shelter. In erecting the shelter having a rope or cord as the erecting guide means, one hand grasps the loop 31 of the rope 13*a*, and while pulling on the rope 13*a*, the second hub 14 is moved with the other hand upwards along rope 13*a* and into its position proximate to the first hub 12. When the shelter has been erected, the rope 13*a*** can be allowed to hang downward from the center of the shelter, or it can be tied back against the inside walls of the shelter using appropriate tying means associated with the inside walls.

Irrespective of whether an elongate rod or a cord or rope is utilized as the erection guide means; the first and second hubs 12 and 14 are quickly connected together as a rigid unit by inserting the cylindrical projection 29 on the second hub 14 into the counterbore 24 of the first hub 12 (see FIG. 4) as the second hub 14 is moved into its position proximate to the first hub 12. The second hub 14 is then rotated by about one-quarter to about three-eighths of a turn about the axis of the erecting means, whereupon the erecting means, the first hub 12, and the second hub 14 are bound together as a rigid unit due to the eccentric nature of the counterbore 24 and cylindrical projection 29 in the hubs 12 and 14, respectively. The erecting rod 13 is shown in FIG. 4 undersized for purposes of clarity. In actual practice, the rod 13, or the rope **13*a* of the embodiment shown in FIG. 3, has a diameter just slightly smaller than the bores 23 and 28 of hubs 12 and 14, thereby facilitating the binding action which occurs when the eccentric, cylindrical projection 29 of the second hub 14 is turned within the eccentric counterbore 24 of the first hub 12**.

The rib members 15 are connected to the second hub 14 by appropriate means which allows rotation of the hub 14 relative to the rib members 15 and about the longitudinal axis of the erecting guide means 13. The connection means, as illustrated, comprises a neck portion 26 (FIG. 4) formed from a concave-shaped, reduced cross section in the second hub 14 intermediate between upper and lower collar portions 27 and 25 thereof, respectively. A ring-shaped member 30 encircles the neck portion 26 of the second hub 14, and circular, ring-shaped hook members 31 are provided on the respective ends of the rib members 15 for pivotal connection to the ring-shaped members 30. The outer circumference of hook members 31 are such that they nest within the concave-shaped neck portion 26 between the collars 27 and 25 of hub 14. The rib members 15 are, thus, adapted for pivotal movement with respect to the ring member 30 and the hub 14, while the hub 14 is itself adapted for rotational movement without causing any corresponding movement in the ring member 30 or the rib members 15 which are attached to the ring member 30.

The means for pivotally connecting the support members 11 to the first hub 12 is similar to that described above for connecting the rib members 15 to the second hub 14, with the exception that rotation of the first hub 12 about the longitudinal axis of the erecting guide means 13 is prohibited. A ring-shaped member 32 encircles the neck portion 21 (FIG. 4) of hub 12, and hook members 33 are provided on the respective ends of the support members 11 which pivotally hook onto the ring-shaped member 32. The neck portion 21 is formed from concave-shaped, reduced cross section in the first hub 12 intermediate between an upper cap portion 20 and a lower collar portion 22, respectively. The outer diameters of hook members 31 are such that they nest within the concave-shaped neck portion 21 between the cap portion 20 and collar portion 22 of the hub 12. To eliminate any substantial rotation of the first hub 12 comparable to the one-quarter to three-eighths turn of the second hub 14, a web member 34 (FIG. 4) bridges the collar portions 20 and 22 across the neck portion 21 of the first hub 12. As illustrated in FIG. 4, the web member 34 comprises a pin extending from the upper cap portion 20 to the lower collar 22, across the neck portion 21. The web member 34 could also be molded integrally with the first hub 12, wherein the web would comprise a relatively thin vertically standing sheet member extending radially outwardly from the neck portion 21 of hub 12. Whether in the form of a sheet, pin, or otherwise, the web member 34 is sized and positioned to fit closely between the hook members 33 of two adjacent support members 11, so that the first hub 12 is restrained from any substantial rotational movement about the longitudinal axis of the erecting guide means 13.

In addition to providing for pivotal connection of the rib members 15 and the support members 11 to their respective hubs 12 and 14, the connecting means as described above also provides for quickly, easily, and inexpensively connecting the rib members 15 and support members 11 to their respective hubs during manufacture of the shelter. Further, individual support members 11 and/or rib members 15 can be quickly and easily removed from their respective hubs 12 and 14 for replacement or other maintenance purposes without removing any of the other members connected to such hubs, and without requiring special tools, equipment, or procedures for retaining the other members in proper connection with such hubs during the removal and replacement of the desired member.

In the embodiment of the invention, which has been described hereinabove, the functions of the first, i.e., central hub 12, and the second hub 14 have been assigned in accordance with one preferred mode of carrying out the invention. It should be understood, however, that at least a portion of the functions assigned to the first and second hubs 12 and 14 could be reversed. For example, the first hub 12 could be adapted for rotation about the axis of the erecting guide 13, and the second hub 14 could be restrained from rotational movement. The erecting guide 13 could then be pulled upwardly through the first or top hub 12, with the top hub being rotated to lock the mechanism.

In general, at least one of the first and second pivotal connecting means (the first means being that which connects the support members 11 to the first or central hub 12 and the second means being that which connects the rib members 15 to the second hub 14) is adapted to allow rotational movement of the mutually respective hub about the longitudinal axis of the guide member 13. One of the first and second hubs 12 and 14, respectively, is provided with a counterbore 24 in the end thereof facing the other hub, with the counterbore 24 being eccentric with the bore 23 which extends through the first hub 12, and, therefore, eccentric with respect to the erecting member 13. The other hub has an upstanding cylindrical portion 29 which is adapted for sliding engagement within the counterbore 24 when the two hubs are moved into their position proximate each other. The upstanding portion 29 is eccentric with respect to the erecting guide 13, and as fully described hereinbefore, when the upstanding portion 29 is engaged in the counterbore 24 and the rotatable hub is rotated by about one-quarter to three-eighths of a turn about the longitudinal axis of the erecting guide 13, the hubs 12 and 14 are bound together with the erecting rod 13 as a rigid unit.

The apex of the cover or canopy 10 of the shelter is attached, as illustrated in the drawings, to the lower end of the second hub 14. As illustrated in FIGS. 2–4, a handle member 36 is attached to the lower end of second hub 14 by counter-sunk screws 37. A circumferential notch is provided between the lower end of the second hub 24 and the top of handle 36, and a ring 38, to which the apex of the cover or canopy 10 is attached, is held within the circumferential notch. The apex of the cover 10 is, thus, easily removed from the frame of the shelter by removing the handle 36 from the second hub 14 thereby freeing the ring 38. The handle 36 is also useful in providing means for manipulating the second hub 14 during the erection and collapsing of the shelter.

The remaining portion of the cover 10 is attached, at various points intermediate its apex and the bottom edge, to the support members 11. As illustrated in FIGS. 1, 6, and 7, a plurality of straps 40 are provided at spaced intervals along the seam connecting adjacent panels 16 of the cover 10. The ends of the straps 40 extending from the cover 10 are provided with locking connectors 41 (FIGS. 6 and 7) which are, in turn, adapted for connection to respective ring members 42 (FIGS. 6 and 7). The ring members 42 circumscribe the support members 11 for sliding movement therealong. The ring members 42 are each provided with a key-like extension 43 which is adapted to engage a locking connector 41 for releasable attachment thereto.

In the embodiment shown in FIGS. 6 and 7, the key-like extension 43 on the ring member 42 comprises a stem 44 (FIG. 7) projecting radially outwardly from the ring member 42. The stem 44 has a substantially square cross section, with a pair of studs 45 at the free end of the stem 44 extending from mutually opposite sides of stem 44 in a direction substantially perpendicular thereto. The locking connector 41 is made of a resilient material, as is the ring member 42. The connector 41 comprises a face portion 46 having a substantially rectangular opening therein which has a width substantially the same as the thickness of the stem 44 of ring member 42 and a height sufficient so that the end of the stem 43 with the lugs 45 thereon can be inserted through such opening. The thickness of the face portion 46 is no greater than the length of the stem 43 between the ring member 42 and the lugs 45.

Means are provided for attaching the locking connectors 41 to their respective straps 40 on the cover 10. As illustrated in FIGS. 6 and 7, a generally D-shaped member 47 is attached to the face portion 46 of the connector 41, and a respective strap 40 is, in turn, attached to the D-shaped members 47.

In attaching the sides of the cover 10 to the support members 11, the end of the stem 43 with the lugs 45 thereon is inserted through the opening in the face portion 46 of connector 41 as is shown by the arrow in FIG. 7. Following insertion of the stem 43 into the opening in the connector 41, the connector 41 is rotated one-quarter turn to snap the stem 43 into locking engagement with the connector 41. Disengagement of the sides of the cover 10 from the support members 11 is accomplished by reversing the above steps, i.e., turning the connector 41 and pulling the stem 43 out of the opening in the connector 41. The ring member 42 and connector 41 are made of a resilient material, and, thus, when the stem 43 is inserted in the opening of connector 41 and the connector 41 is turned, both the stem 43 and the connector 41 elastically deform thereby allowing the stem 43 to snap to a stable position in which the lug members 45 lock the stem 43 in engagement with the connector 41. The connector 41 will not snap back to the position in which the stem 43 can be withdrawn from the opening in connector 41, without exerting sufficient torque on the connector 41 to again elastically deform the connector 41 and stem 43 whereby the stem 43 snaps back to its position in which it can be withdrawn from the opening in connector 41. Preferably, the connector 41 and ring member 42 are made of a resilient polymer, such as nylon, polyurethane, polyethylene, polypropylene, butadiene, styrene-butadiene, etc.

The ring members 42 are freely slidable along their respective support members 11, so that the cover 10 readily slides along the support members during erection of the tent as well as when the tent is being taken down and made ready for storage. The ease in which the ring members 42 slide along their respective support members 11 is unaffected by various atmospheric conditions. In particular, the shelter is as easily erected and taken down in a wet condition, such as during a rainstorm, as it is in a dry condition.

The cover 10 can be advantageously removed from the frame of the shelter for cleaning purposes, repair, etc., by simply disconnecting all the connectors 41 from their mutually respective ring members 42 on the respective support members 11 and disconnecting the apex of the cover 10 from the second hub 14. Following cleaning or repair of the cover, it is easily reinstalled on the frame by connecting the apex of the cover back to the second hub 14 and reconnecting the mutually respective connectors 41 and ring members 42.

The bottom and/or floor of the shelter is conveniently attached to the ground engaging ends of the support members 11 by means of novel foot members 50 on the support members 11 as shown in FIGS. 8 and 9. The foot member 50 comprises a central body portion 51 which is attached to the ground engaging end of a respective support member 11. Preferably, the body portion 51 is cylindrical in shape having a bore extending coaxially, inwardly from one end thereof, with the bore being adapted to receive the end of the respective support member 11. A substantially flat, elongate base member 52 is attached intermediate its ends to the other end of the body portion 51 so that the base 52 is positioned adjacent to the end of the respective support member 11, with the longitudinal axis of the base 52 being substantially normal to a vertical plane through the center of the shelter and containing the support member 11. An elongate opening 53 (FIG. 9) is provided through the base 52 from the outside to the inside thereof. The opening 53 is adapted to receive a strip 54 (FIG. 8) of fabric which is attached at one of its ends to the bottom of the cover of the shelter at the seam between two adjacent panels 16. The other end of the strip 54 passes through the opening in the base 52 from the inside to the outside, whereupon the strip 54 is folded back upon and attached to itself to form a loop on the outside of the base 52. The opening in the base is adapted to receive only a single thickness of the strip 54, so that the loop cannot be pulled back through the opening. The underside of the base 52 of the foot member sits on the ground when the shelter is erected, and the loop in the strip 54 of fabric on the outside of the foot member 50 provides an advantageous means for wrapping around and engaging ground stakes which are driven into the ground, and, thus provide extra stability for the shelter during windy and gusty conditions.

A rain fly (not shown in the drawings) can be provided covering at least the upper portion of the canopy 10 for added protection from rain and as an insulation from direct rays from the sun. The foot member 50 is also advantageously adapted to provide anchoring support for the rain fly. As shown in FIGS. 8 and 9, the foot member 50 also includes at least one limb member 55 extending outwardly from the body portion 51. The limb members 55 are parallel to and spaced from the base 52, thereby forming elongate slots 56 (FIG. 9) between the wing members 55 and the base 52. The slots 56 are adapted to receive a tie rope or cord 57 (FIG. 8), which has a diameter no greater than that which can be forced into the slot 56. The tie rope 57 is thus anchored to the foot member 50. The other end of the rope 57, which is not shown in the drawings, is advantageously used to anchor or hold the rain fly taut. The wing members are made of a resilient material, and preferably molded of a resilient polymer integrally with the other parts of the foot member 50. The free end of the wing members 55 can be provided with lugs 58, respectively, which extend toward the base but are still spaced therefrom, so as to provide a constricted opening to the slot 56. The tie rope 57 can be anchored to the foot member 50 as shown in FIG. 8, by tying a knot 59 in the end of the rope 57, forcing the end through the opening and into one of the slots 56 in the foot member 50 so that the knot 59 is adjacent to the side of the foot member 50. This single tie is usually strong enough to hold the rain fly. For additional strength, the rope 57 may then also be passed around the body portion 51 of the foot member 50 and forced through the opening and into the other slot 56. Alternatively, the rope 56 coming from the rain fly or other application can be forced through the opening and into one of the slots 56, passed around the body portion 51, forced through the opening and into the other slot 56, and then again passed around the body portion and forced through the opening and into the first slot 56 again.

Preferred means for pivotally attaching mutually respective ends of the rib members 15 to corresponding respective support members 11 is shown in FIGS. 3 and 5. As shown, hinge members 60 are mounted on respective support members 11, each hinge member 60 having a pair of substantially flat lugs 61 extending from mutually opposite sides of the respective support member 11 inwardly in substantially parallel relationship toward the central portion of the shelter. The flat lugs 61 have opposed openings 62 (FIG. 5) having a common axis through the lugs. Corresponding pin members are positioned on the ends of the respective rib members 15 which are adapted to be snapped into engagement with the opposed openings 62 in the hinge members 60, so that the respective rib member 15 can pivot about the common axis of the openings 62. Preferably, the pin members comprise cylindrical cap members 63 which are adapted to slide over the ends of the respective rib members 15. Each of the cap members 63 has a pair of pegs 64 (FIG. 5) extending outwardly in opposite directions from the end thereof, whereby the pegs 64 are adapted to be snapped into engagement with the openings 62 in the hinge member 60.

As mentioned hereinbefore each of the support members 11 is preferably segmented so that the collapsed shelter can be folded up into a compact package. As shown in FIG. 2, each support member 11 preferably comprises a plurality of cylindrical sections, with elastic means extending through the cylindrical sections. The ends of adjacent cylindrical sections are provided with, respectively, a male end and a female end for interconnectingly coupling the sections together. The elastic means (shown by numeral 19 in FIG. 2) maintains continuity between adjacent sections when they are in their folded form, as well as urges the adjacent sections into longitudinal coupling relationship when the sections are brought into end-to-end position. Particular constructions of such segmented members 11 are fully described in U.S. Pat. No. 3,794,054.

While the preferred embodiment of the collapsible shelter has been described above for use mainly as a tent, the invention can also be used to construct a floorless clothes-changing shelter for use, for example, at the beach. The invention can also be used to design a very large collapsible beach umbrella, in which case the erecting means 13 would comprise a rod extending downwardly to the ground and support members 11 would extend only to the edge of a canopy-type cover.

Although the invention has been described in detail with respect to particularly preferred embodiments thereof, it will be understood by those of ordinary skill in the art that variations and modifications may be effected without departing from the subject matter coming within the scope of the following claims, which subject matter is regarded as the invention.

I claim:

1. In a collapsible shelter of the umbrella-tent type wherein the shelter includes a foldable frame and a cover of sheet material affixed to the frame, with said frame comprising an elongate erecting guide; a plurality of support members for supporting said cover when said frame is erected; a first hub mounted on said erecting guide; first pivotal connecting means for pivotally connecting mutually respective ends of said support members to said first hub, so that when the shelter is erected, the support members extend outwardly and downwardly from said first hub, and when the shelter is collapsed, the support members extend downardly as a bundle, with the support members being in proximate side-by-side relationship; a second hub mounted on said erecting guide below said first hub, said first and second hubs being adjustable between a collapsed position in which said first and second hubs are located remote from each other, and an erected position, in which the first and second hubs are proximate each other; a plurality of rib members, equal in number to the number of support members; second pivotal connecting means for pivotally connecting mutually respective ends of said rib members to the second hub; means for pivotally connecting the other mutually respective ends of said rib members to corresponding support members, such that when the shelter is erected, said rib members extend substantially radially outwardly from said erecting guide and when the shelter is collapsed, said rib members extend downwardly, substantially within said bundle of collapsed, support members, the improvement comprising:

providing a cylindrical bore through said first hub from the upper end to the lower end thereof, with said erecting guide passing longitudinally through said bore in said first hub;

at least one of said first and second pivotal connecting means is adapted to allow rotational movement of the respective hub associated therewith about the longitudinal axis of said guide member; and means are provided for releasably connecting and holding said first and second hubs together as a rigid unit when said first and second hubs are located proximate each other in the erected position, thereby avoiding untimely collapse of said shelter by inadvertent, undesired movement of said first and second hubs to a position separate and apart from each other, said means for releasably connecting said first and second hubs together as a rigid unit comprising:

one of said first and second hubs having a counterbore in the end thereof facing the other hub, said counterbore being eccentric with the bore which extends through said first hub, and, therefore, eccentric with respect to the erecting member positioned within said bore; and the other hub having an upstanding cylindrical portion forming its end which faces the hub having the counterbore, said upstanding cylindrical portion being adapted for sliding engagement within said counterbore, said upstanding-cylindrical portion also being eccentric with respect to the erecting guide which, in turn, extends from the free end of said upstanding cylindrical portion and through the bore in the mutually opposite hub, whereby, when said upstanding cylindrical portion is engaged in said counterbore and one of the hubs is rotated by about one-quarter to three eighths of a turn about the longitudinal axis of said erecting guide, said first and second hubs are bound together with said erecting guide as a rigid unit.

2. The improved, collapsible shelter in accordance with claim 1, wherein the erecting guide is an elongate rod which is adapted for longitudinal sliding movement through the bore in said first hub.

3. The improved collapsible shelter in accordance with claim 2, wherein the second hub has a cylindrical bore therethrough from one end to the other end thereof, with the erecting rod fitting longitudinally through said bore in said second hub for sliding movement therethrough.

4. The improved, collapsible shelter in accordance with claim 1, wherein the erecting guide is a rope or cord which passes through the bore in said first hub, with the end of said rope or cord which extends from the upper end of said first hub being provided with means whereby it is restrained from being pulled downwardly through the bore in said first hub, and the second hub has a cylindrical bore therethrough from one end to the other end thereof, with the portion of the rope or cord from the lower end of said first hub passing through said bore in said second hub for sliding movement of said second hub along said portion of said rope or cord.

5. The improved, collapsible shelter in accordance with claim 2, wherein the second hub is mounted integrally to the bottom end of the erecting rod.

6. The improved, collapsible shelter in accordance with claim 1, wherein said second pivotal connecting means for pivotally connecting the rib members to the second hub is adapted to allow rotational movement of said second hub about the longitudinal axis of said elongate guide member; and the means for releasably connecting the first and second hubs together as a rigid unit comprises:

a counterbore in the lower end of said first hub facing said second hub, said counterbore being eccentric with the bore which extends through said first hub, and, therefore, eccentric with respect to the erecting member positioned within said bore; and an upstanding cylindrical portion forming the end of the second hub which faces said first hub, said cylindrical portion being adapted for sliding engagement within said counterbore, said cylindrical portion also being eccentric with respect to the erecting guide which, in turn, extends from the free end of said cylindrical portion and through the bore in said first hub, whereby, when said cylindrical portion of said second hub is engaged in the counterbore of said first hub, and said second hub is rotated by about one-quarter to three-eighths of a turn about the longitudinal axis of said erecting guide, said first and second hubs are bound together with said erecting guide as a rigid unit.

7. The improved, collapsible shelter in accordance with claim 6, wherein the means for pivotally connecting the support members to the first hub comprises a neck portion in said first hub formed from a reduced cross section therein intermediate between an upper cap portion and a lower collar portion of said first hub; a ring member encircling said neck portion for pivotally connecting the mutually respective ends of said support members thereto; and means for restraining said first hub from rotational movement about the longitudinal axis of the bore therethrough.

8. The improved collapsible shelter in accordance with claim 7, wherein the means for restraining the first hub from rotational movement about the longitudinal axis of the bore therethrough comprises a web or pin member having one end thereof connected to the cap portion on the upper side of the neck portion of said hub and the other end thereof connected to the collar portion on the lower side of said neck portion, so that said pin member bridges said neck portion and wedges between two of the mutually respective ends of said support members, thereby preventing rotational movement of the first hub.

9. The improved collapsible shelter in accordance with claim 8, wherein the means for pivotally connecting the rib members to the second hub comprises a neck portion in said second hub formed from a reduced cross section therein intermediate between an upper and lower collar portion of said second hub; and a ring shaped member encircling said neck portion of said second hub for pivotally connecting the mutually respective ends of said rib members thereto.

* * * * *